US006435882B1

(12) United States Patent
Pitou

(10) Patent No.: US 6,435,882 B1
(45) Date of Patent: Aug. 20, 2002

(54) SOCKETABLE FLEXIBLE CIRCUIT BASED ELECTRONIC DEVICE MODULE AND A SOCKET FOR THE SAME

(75) Inventor: David S. Pitou, San Jose, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/919,562

(22) Filed: Jul. 27, 2001

(51) Int. Cl.[7] ..... H01R 12/01
(52) U.S. Cl. ..... 439/70
(58) Field of Search ..... 439/70, 71, 72, 439/73, 66, 67, 339

(56) References Cited

U.S. PATENT DOCUMENTS 4,489,999 A 12/1984 Miniet ..... 439/67
4,699,593 A * 10/1987 Grabbe et al. ..... 439/71
4,832,612 A * 5/1989 Grabbe et al. ..... 439/71
4,954,878 A * 9/1990 Fox et al. ..... 257/675
5,072,284 A 12/1991 Tamura et al. ..... 257/680
5,199,882 A * 4/1993 Bates et al. ..... 439/67
5,311,007 A 5/1994 Kato ..... 250/208
5,485,351 A 1/1996 Hopfer et al. ..... 361/704
5,785,535 A 7/1998 Brodsky et al. ..... 439/73
6,011,294 A 1/2000 Wetzel ..... 257/434
6,015,301 A 1/2000 Brodsky et al. ..... 439/73
6,053,745 A 4/2000 Miyata et al. ..... 439/64
6,204,556 B1 3/2001 Hakamata ..... 257/728

* cited by examiner

*Primary Examiner*—Tulsidas Patel

(57) ABSTRACT

Socketable flexible circuit based electronic device modules and sockets for electrically and mechanically connecting the electronic device modules to an interconnect substrate are described. The systems provide ways in which the electronic device module may be positioned accurately and securely on an interconnect carrier, while allowing the electronic device modules to be replaced easily without having to resort to laborious desoldering and resoldering operations to remove the modules and connect new modules in their place.

19 Claims, 6 Drawing Sheets

SOCKETABLE FLEXIBLE CIRCUIT BASED ELECTRONIC DEVICE MODULE AND A SOCKET FOR THE SAME

TECHNICAL FIELD

This invention relates to schemes for connecting flexible circuit based electronic device modules to an interconnect substrate through a socket connection.

BACKGROUND

The use of flexible printed circuits has become quite widespread because of their low cost, ease of assembly in interconnection systems, and the low volumes that they occupy. A flexible printed circuit (or "flex circuit") typically includes a strip or cable with a plurality of embedded electrically conductive lines. The conductive lines may be formed on a relatively thin base layer of insulative material, such as a polyimide sheet or the like. The conductive lines are covered by an overlying layer of insulative material to form an elongated and relatively flexible circuit structure. Apertures may be formed in one of the insulation layers to expose portions of the conductive lines for electrical connection to other electronic components (e.g., the conductors of a complementary mating connecting device, which may be a second flat flexible circuit, a printed circuit board or the terminals of a mating connector). A zero insertion force (ZIF) connector typically provides an electrical interface between the flexible printed circuit and a printed circuit board.

Electronic components may be mounted on flexible printed circuits that, in turn, may be incorporated into electronic device modules, such as charged coupled device (CCD) sensors and complementary metal-oxide-semiconductor (CMOS) sensors. In some cases, a flexible printed circuit may be connected to an interconnect substrate (e.g., a printed circuit board) through a multi-layer ceramic dual-in-line (DIP) package (see, e.g., U.S. Pat. Nos. 5,072,084 and 5,311,007). In other cases, a flexible printed circuit may be connected to an interconnect substrate through a zero insertion force connector. For example, U.S. Pat. No. 6,011,294 discloses a charged coupled device packaging in which an image sensor is housed within a ring frame and is mounted on a flexible circuit board that may be connected to a printed circuit board through a standard zero insertion force connector, an anisotropic adhesive, or a traditional solder butt joint.

SUMMARY

The invention features socketable flexible circuit based electronic device modules and sockets for electrically and mechanically connecting the electronic device modules to an interconnect substrate. These systems provide inventive ways in which the electronic device modules may be positioned accurately and securely on an interconnect carrier, while allowing the electronic device modules to be replaced easily without having to resort to laborious desoldering and resoldering operations to remove the modules and connect new modules in their place.

In one aspect, the invention features an electronic device module socket that includes a support frame, a retainer, and an electrical connector. The support frame is constructed and arranged to receive the electronic device module. The retainer is constructed and arranged to engage and thereby mechanically hold the electronic device module in place. The electrical connector is constructed and arranged to electrically connect the plurality of elongated flexible circuit board conductors to a corresponding plurality of electrical conductors of the interconnect substrate.

Embodiments in accordance with this aspect of the invention may include one or more of the following features.

The electrical connector preferably is constructed and arranged to be biased against the plurality of elongated flexible circuit board conductors when the electronic device module is mechanically held in place by the retainer. The electrical connector may comprise a plurality of electrically conductive spring fingers or an elastomeric anisotropic electrically conductive film.

The retainer preferably has a latch portion that is configured to yield during insertion of the electronic device module into the socket and to snap back over an edge of the electronic device module when fully inserted into the socket. The support frame and the retainer may be incorporated within a unitary structure.

In another aspect, the invention features a socketable electronic device module that includes a housing, one or more electronic components, and a flexible circuit board. The housing is constructed and arranged to be inserted within an electronic device module socket for electrical and mechanical connection to an interconnect substrate. The flexible circuit board comprises a flexible substrate having a component portion supporting the one or more electronic components and a contact portion supporting a plurality of elongated electrical conductors and coupled to the component portion through a curved portion. The component portion of the flexible substrate is disposed within the housing and the contact portion of the flexible substrate is disposed outside of the housing and is exposed for electrical contact with an electrical connector of the electronic device module socket.

Embodiments in accordance with this aspect of the invention may include one or more of the following features.

In some embodiments, the one or more electronic components may be supported on one surface of the flexible substrate and at least a portion of the electrical conductors may be supported on an opposite surface of the flexible is substrate. In these embodiments, the contact portion of the flexible substrate may be substantially orthogonal to the component portion of the flexible substrate.

In other embodiments, the one or more electronic components and the electrical conductors are supported on the same surface of the flexible substrate. In these embodiments, the contact portion of the flexible substrate may be substantially parallel to the component portion of the flexible substrate, and the flexible substrate may be folded at the curved portion.

In another aspect, the invention features a socket-based system for electrically and mechanically connecting an interconnect substrate and an electronic device module.

Other features and advantages of the invention will become apparent from the following description, including the drawings and the claims.

DETAILED DESCRIPTION

Figure 1:
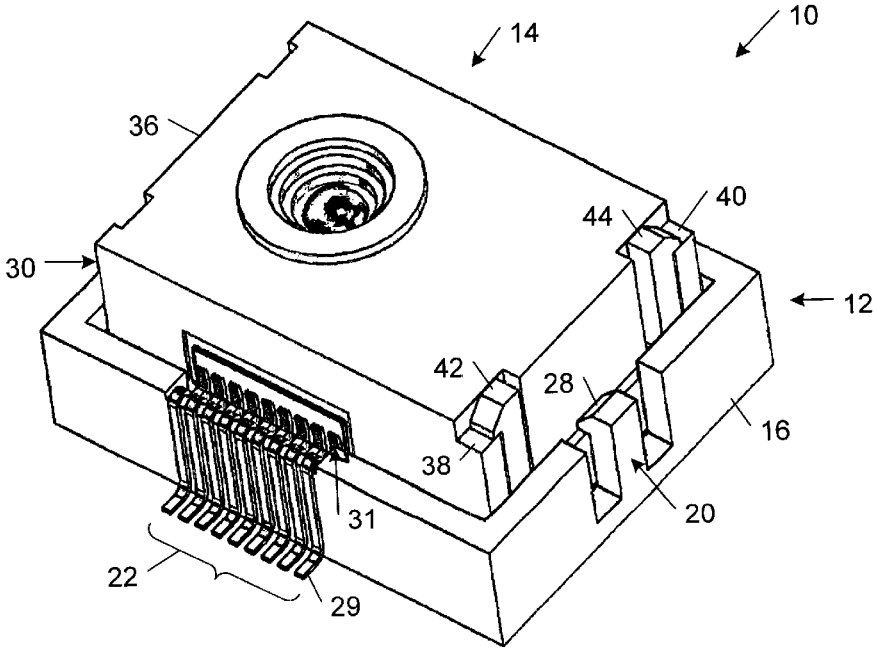
FIG. 1 is a diagrammatic perspective top view of a flexible circuit based electronic device module that is plugged into a socket.

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Referring to FIGS. 1, 2A, 2B, 2C and 2D, in one embodiment, a socket-based electrical and mechanical circuit connection system 10 includes a socket 12 and a socketable flexible circuit based electronic device module 14.

Socket 12 is constructed and arranged to electrically and mechanically connect electronic device module 14 to an interconnect substrate (e.g., a printed circuit board). In particular, socket 12 includes a support frame 16, a pair of retainers 18, 20, and a pair of electrical connectors 22, 24. Support frame 16 has four sidewalls that define a recess for receiving electronic device module 14. Each retainer 18, 20 includes a respective latch portion 26, 28 that is configured to yield during insertion of electronic device module 14 into socket 12 and to snap back over a respective edge of electronic device module 14 when electronic device module 14 is fully seated within socket 12. In this way, retainers 18, 20 operate to mechanically hold electronic device module 14 in place with respect to socket 12. In some embodiments, support frame 16 and retainers 18, 20 may be incorporated into a unitary structure, which may be formed from a plastic material that is molded by a conventional injection molding process. In other embodiments, support frame 16 and retainers 18, 20 may be formed as separate components from any of a wide variety of different materials.

Figure 2A:
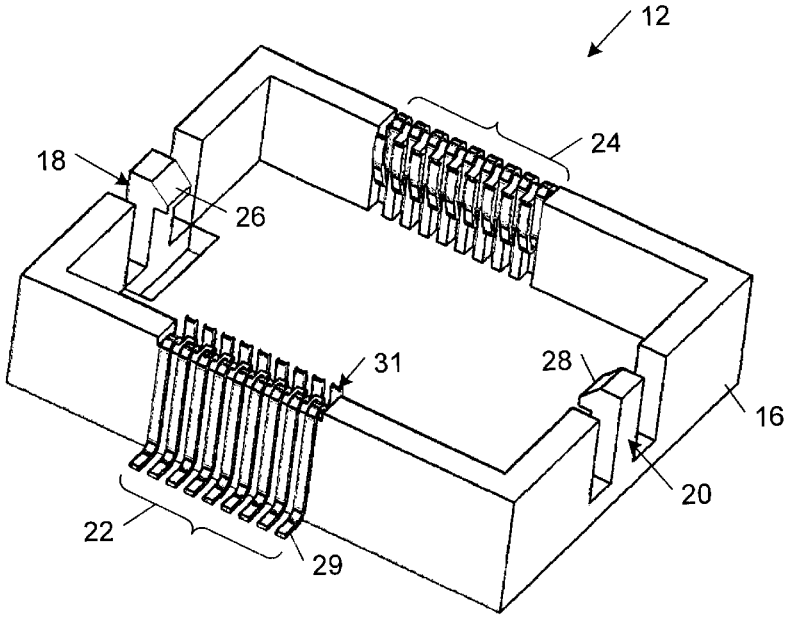
FIG. 2A is a diagrammatic perspective view of the electronic device module socket of FIG. 1.
Figure 2B:
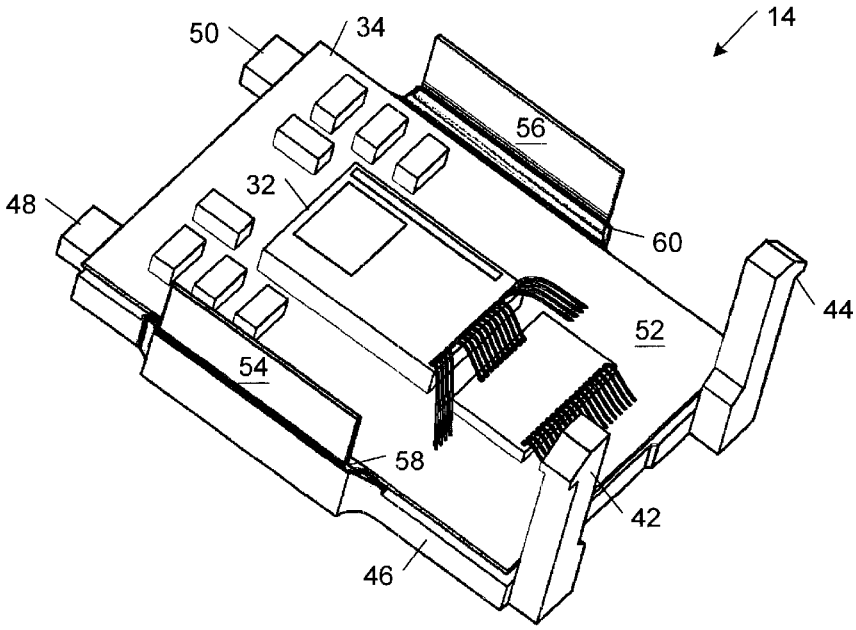
FIG. 2B is a diagrammatic perspective view of the flexible circuit based electronic device module of FIG. 1 without a top housing portion.
Figure 2C:
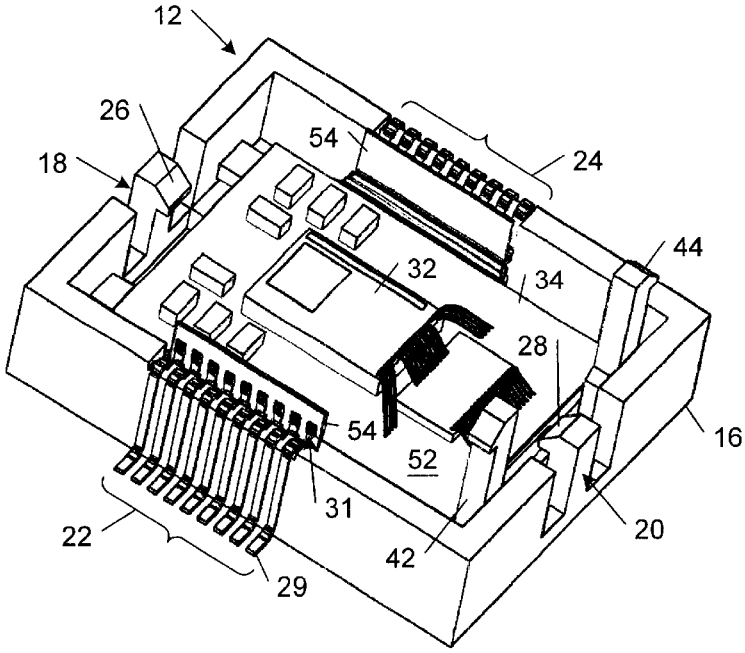
FIG. 2C is a diagrammatic perspective view of the flexible circuit based electronic device module of FIG. 2B plugged into the socket of FIG. 2A.
Figure 2D:
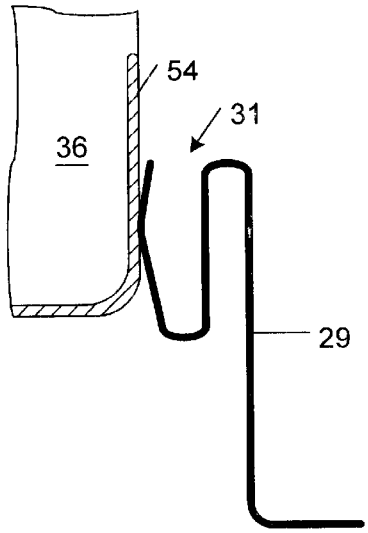
FIG. 2D is a diagrammatic cross-sectional side view of an electrical socket conductor with a spring finger portion biased against a contact portion of the electronic device module of FIG. 1.

Electrical connectors 22, 24 each includes a plurality of resilient electrical conductors 29, each of which includes a spring finger portion 31 that protrudes into the recess defined by the sidewalls of support frame 16. Each spring finger portion 31 is biased (or spring loaded) against a corresponding electrical conductor of a contact portion of electronic device module 14 (described in detail below) when the electronic device module is held in place by retainers 18, 20. Each spring finger 29 preferably contacts the corresponding electrical conductor of electronic device module 14 over a relatively small area so that the contact pressure exerted by the spring fingers is relatively high. As shown in FIG. 2D, in this embodiment, each spring finger portion 31 forms an "S"-shaped curve with the distal end extending away from the recess defined by the socket sidewalls. In other embodiments, each spring finger portion may form a "C"-shaped curve with the distal end extending toward the recess defined by the socket sidewalls. Still other spring finger arrangements are possible.

Socket 12 may be connected to an interconnect substrate by any conventional surface mount process (e.g., an infrared solder reflow process).

Electronic device module 14 includes a housing 30, one or more electronic components 32 and a flexible circuit board 34.

Housing 30 includes a top housing portion 36 that has a pair of tabs 38, 40 (FIG. 1) that are configured to engage a pair of mating latches 42, 44 of a bottom housing portion 46. Top housing portion 36 also includes a pair of slots (not shown) that are configured to receive a pair of flanges 48, 50 that protrude from one end of bottom housing portion 46. Top housing portion 36 and bottom housing portion 46 each may be formed from a plastic material that is molded by a conventional injection molding process. In operation, flanges 48, 50 slide into the slots of top housing portion 36 and latches 42, 44 snap down over tabs 38, 40 to hold top housing portion 36 and bottom housing portion 46 together.

The electronic components 32 may be semiconductor-based devices (e.g., integrated circuits and sensors) and other active or passive devices. In the illustrated embodiment, electronic components 32 correspond to the components of an image sensor (e.g., a CMOS image sensor available from Agilent Technologies, Inc. of Palo Alto, Calif., USA), including an image sensor chip and a number of peripheral electrical devices.

Electronic components 32 are coupled mechanically and electrically by flexible circuit board 34. Flexible circuit board 34 may include a pattern of elongated electrical conductors formed on a plastic (e.g., polyimide) substrate surface. The electrical conductors may be formed from any one of a wide variety of electrically conductive materials, such as the electrically conductive materials that are used commonly in the circuit board industry. In one embodiment, the electrical conductors are formed, from copper with nickel and gold plating. Electronic components 32 may be connected to the electrical conductor pattern of flexible circuit board 34 by a conventional wire bonding process. In the embodiments of FIGS. 1–2D, flexible circuit board 34 includes a component portion 52, a pair of contact portions 54, 56, and a pair of curved portions 58, 60 that physically couple contact portions 54, 56 to component portion 52. Component portion 52 is substantially planar and corresponds to the area where electronic components 32 are mounted to flexible circuit board 34. Contact portions 54, 56 are electrically coupled to the electronic components 32 by a plurality of electrical conductors that extend from the contact portions 54, 56, through curved portions 58, 60, to the pattern of electrical conductors formed in component portion 52. In this embodiment, contact portions 54, 56 are oriented substantially orthogonally to component portion 52 and extend outside of housing 30 (as shown in FIGS. 1 and 2D) to enable electronic component module 14 to electrically couple to the electrical connectors 22, 24 of socket 12. To this end, the electrical conductors of contact portions 54, 56 are formed on a surface of flexible circuit board 34 that is opposite the surface on which electronic components 32 are mounted. The backsides of contact portions 54, 56 are supported by top housing portion 36 to resist the contact force exerted by the socket spring finger portions 31 when electronic device module 14 is fully seated within socket 12.

Referring to FIGS. 3, 4A, 4B, 5A and 5B, in another embodiment, a socketbased electrical and mechanical circuit connection system 70 includes a socket 72 and a socketable flexible circuit based electronic device module 74. In this embodiment, socket 72 is configured to electrically connect to a contact portion of a flexible circuit board that is disposed at the bottom side of electronic device module 74.

Figure 4A:
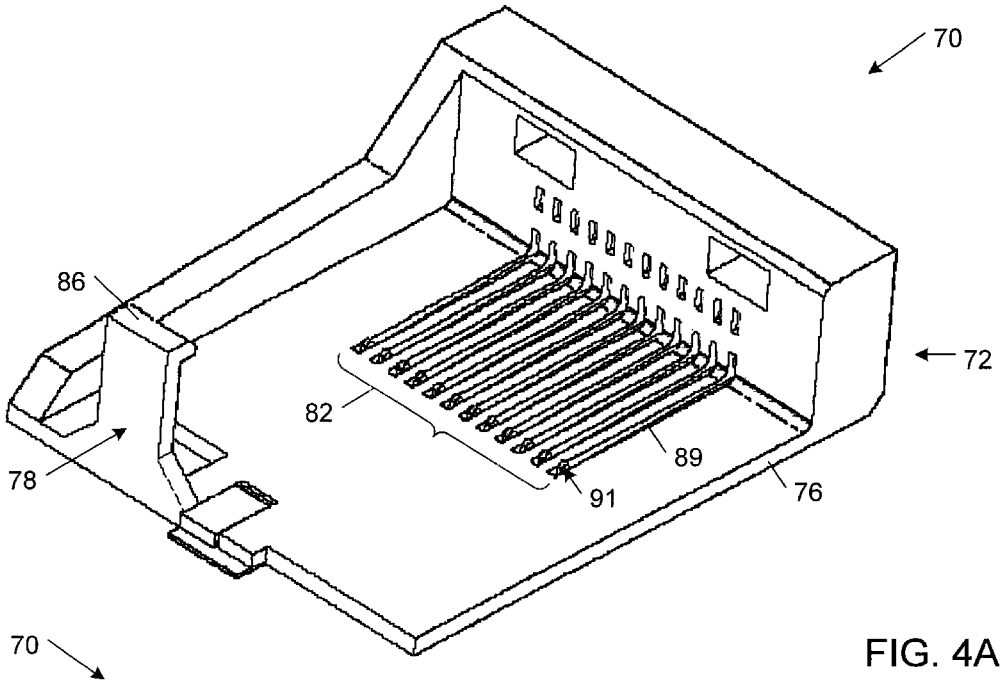
FIG. 4A is a diagrammatic perspective top view of the electronic device module socket of FIG. 3.
Figure 4B:
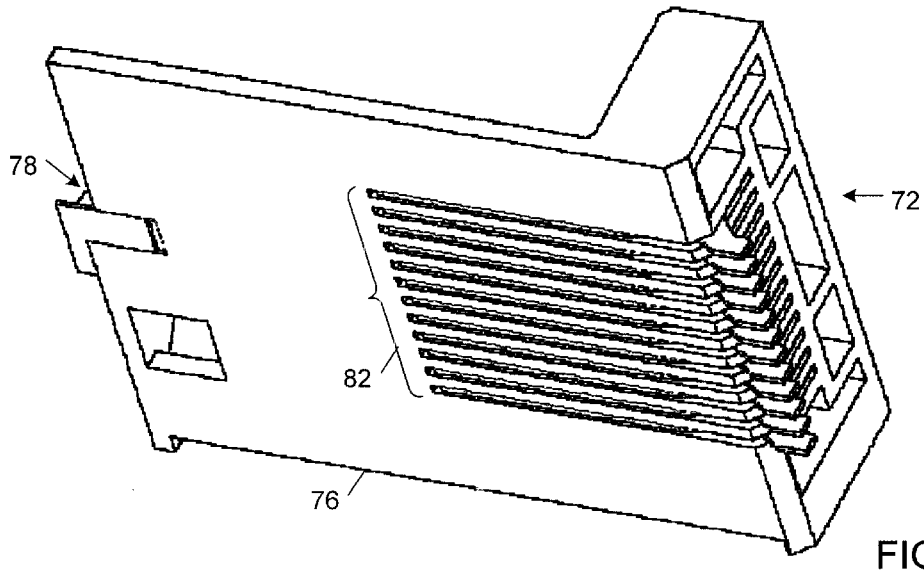
FIG. 4B is a diagrammatic perspective bottom view of the electronic device module socket of FIG. 3.

As shown in FIGS. 4A and 4B, socket 72 is constructed and arranged to electrically and mechanically connect electronic device module 74 to an interconnect substrate (e.g., a printed circuit board). In particular, socket 72 includes a support frame 76, a retainer 78, and an electrical connector 82. Support frame 76 has two adjacent sidewalls that, together with retainer 78, define a recess for receiving electronic device module 74. Retainer 78 includes a latch portion 86 that is configured to yield during insertion of electronic device module 74 into socket 72 and to snap back over a respective edge of electronic device module 74 when electronic device module 74 is fully seated within socket 72. In this way, retainer 78 operates to mechanically hold electronic device module 74 in place with respect to socket 72. In some embodiments, support frame 76 and retainer 78 may be incorporated into a unitary structure, which may be formed from a plastic material that is molded by a conventional injection molding process. In other embodiments, support frame 76 and retainer 78 may be formed as separate components from any of a wide variety of different materials. Electrical connector 82 includes a plurality of resilient electrical conductors 89, each of which includes a spring finger portion 91 that protrudes into the recess defined by the sidewalls of support frame 76. Each spring finger portion 91 is biased (or spring loaded) against a corresponding electrical conductor of a contact portion of electronic device module 74 (described in detail below) when the electronic device module 74 is held in place by retainer 78. Each spring finger 89 preferably contacts the corresponding electrical conductor of electronic device module 74 over a relatively small area so that the contact pressure exerted by the spring fingers is relatively high. Socket 72 may be connected to an interconnect substrate by any conventional surface mount process (e.g., an infrared solder reflow process).

Figure 3:
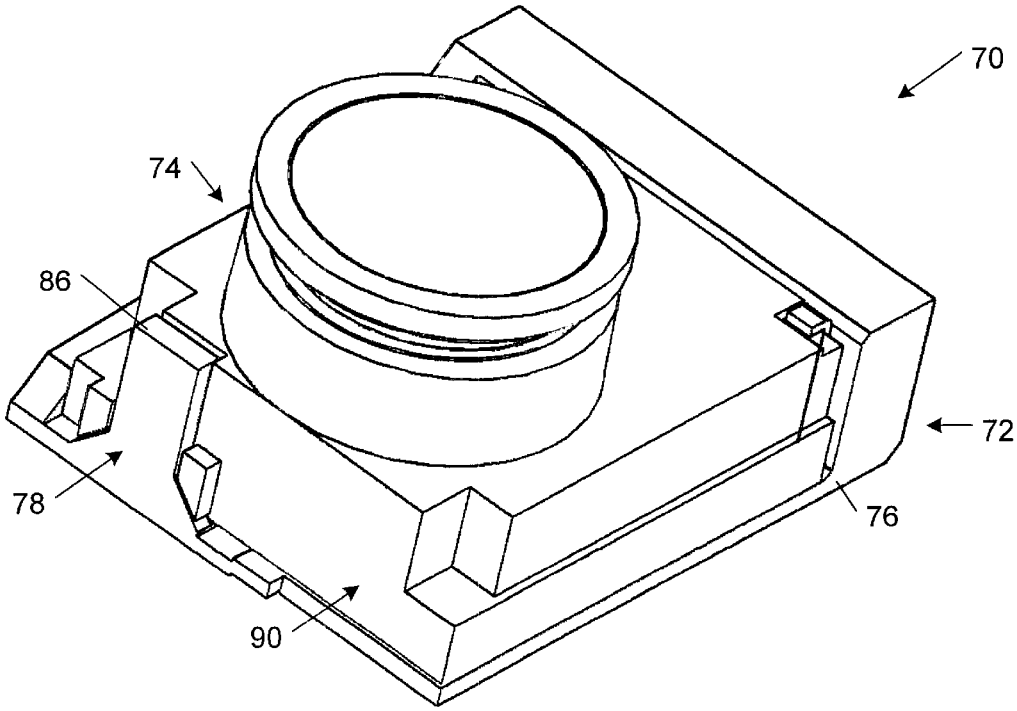
FIG. 3 is a diagrammatic perspective top view of an alternative flexible circuit based electronic device module that is plugged into a socket.
Figure 5A:
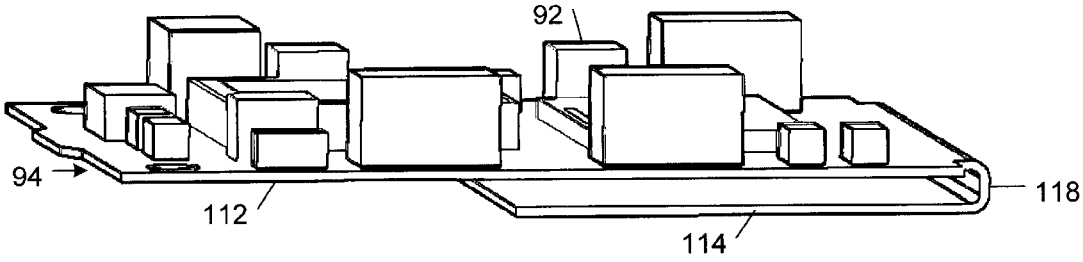
FIG. 5A is a diagrammatic perspective side view of the flexible circuit based electronic device module of FIG. 3 without a top housing portion.
Figure 5B:
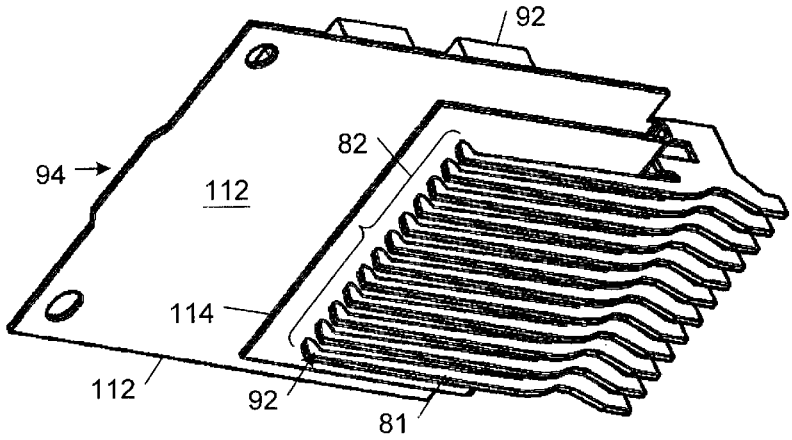
FIG. 5B is a diagrammatic perspective bottom view of the flexible circuit based electronic device module of FIG. 5A, and an electrical connector of the socket of FIG. 3 coupled to a contact portion of the electronic device module.

Referring to FIGS. 3, 5A and 5B, electronic device module 74 includes a housing 90, one or more electronic components 92 and a flexible circuit board 94.

Housing 90 may include a top portion and a bottom portion that may be constructed and arranged in a way that is similar to the construction and arrangement of electronic module housing 30 (described above). Housing 90 may be formed from a plastic material that is molded by a conventional injection molding process.

The electronic components 92 may be semiconductor-based devices (e.g., integrated circuits and sensors) and other active or passive devices. In the illustrated embodiment, electronic components 92 correspond to the components of an image sensor (e.g., a CMOS image sensor available from Agilent Technologies, Inc. of Palo Alto, Calif., USA), including an image sensor chip and a number of peripheral electrical devices.

Electronic components 92 are coupled mechanically and electrically by flexible circuit board 94. Flexible circuit board 94 may include a pattern of elongated electrical conductors formed on a plastic (e.g., polyimide) substrate surface. The electrical conductors may be formed from any one of a wide variety of electrically conductive materials that are used conventionally in the circuit board industry. In one embodiment, the electrical conductors are formed from copper with nickel and gold plating. Electronic components 92 may be connected to the electrical conductor pattern of flexible circuit board 94 by a conventional wire bonding process. In the embodiments of FIGS. 3-5B, flexible circuit board 94 includes a component portion 112, a contact portion 114, and a curved portion 118 that physically couple contact portion 114 to component portion 112. Component portion 112 is substantially planar and corresponds to the area where electronic components 92 are mounted to flexible circuit board 94. Contact portion 114 is electrically coupled to the electronic components 92 by a plurality of electrical conductors that extend from the contact portion 114, through curved portion 118, to the pattern of electrical conductors formed in component portion 112. In this embodiment, contact portion 114 is oriented substantially parallel to component portion 112 and extends outside of housing 90 to enable electronic component module 74 to electrically couple to the electrical connector 82 of socket 72. To this end, flexible circuit board 94 is folded at curved portion 118, and the electrical conductors of contact portion 114 and electronic components 92 are disposed on the same surface of flexible circuit board 94. The backside of contact portion 114 is supported by housing 90 to resist the contact force exerted by the socket spring finger portions 91 when electronic device module 74 is fully seated within socket 72.

In sum, the above-described socket-based electrical and mechanical circuit connection systems provide unique ways in which electronic device modules may be positioned accurately and securely on an interconnect carrier, while allowing the electronic device modules to be replaced easily without having to desolder the modules and resolder new modules in their place.

Other embodiments are within the scope of the claims.

For example, in some embodiments, the spring loaded electrical conductors of the socket electrical connectors may be replaced by a conventional anisotropic electrically conductive film.

Figure 6:
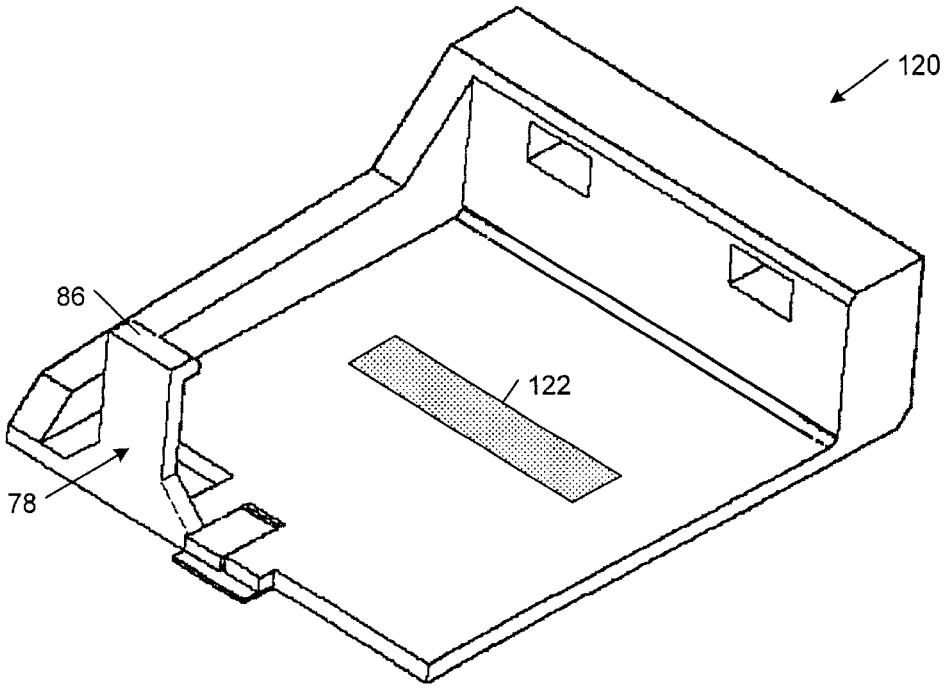
FIG. 6 is a diagrammatic perspective top view of an electronic device module socket.

See, for example, socket 120 of FIG. 6, which corresponds to socket 72 of FIG. 4A with electrical connector 82 replaced by an elastomeric anisotropic electrically conductive film 122. In these embodiments, the retaining force applied by the socket retainers would be sufficient to hold the anisotropic electrically conductive film in electrical contact with the contact portions of the electronic device modules.

What is claimed is:

1. An electronic device module socket for electrically and mechanically connecting an interconnect substrate and an electronic device module having one or more electronic components mounted on a flexible circuit board supporting a plurality of elongated electrical conductors, the socket comprising:

a support frame constructed and arranged to receive the electronic device module;

a retainer constructed and arranged to engage and thereby mechanically hold the electronic device module in place, wherein the retainer has a latch portion configured to yield during insertion of the electronic device module into the socket and to snap back over an edge of the electronic device module when fully inserted into the socket; and an electrical connector constructed and arranged to electrically connect the plurality of elongated flexible circuit board conductors to a corresponding plurality of electrical conductors of the interconnect substrate.

2. The electronic device module socket of claim 1, wherein the electrical connector is constructed and arranged to be biased against the plurality of elongated flexible circuit board conductors when the electronic device module is mechanically held in place by the retainer.

3. The electronic device module socket of claim 2, wherein the electrical connector comprises a plurality of electrically conductive spring fingers.

4. The electronic device module socket of claim 2, wherein the electrical connector comprises an elastomeric anisotropic electrically conductive film.

5. An electronic device module socket for electrically and mechanically connecting an interconnect substrate and an electronic device module having one or more electronic components mounted on a flexible circuit board supporting a plurality of elongated electrical conductors, the socket comprising:

a support frame constructed and arranged to receive the electronic device module;

a retainer constructed and arranged to engage and thereby mechanically hold the electronic device module in place, wherein the support frame and the retainer are incorporated within a unitary structure; and an electrical connector constructed and arranged to electrically connect the plurality of elongated flexible circuit board conductors to a corresponding plurality of electrical conductors of the interconnect substrate.

6. A socketable electronic device module, comprising:

a housing constructed and arranged to be inserted within an electronic device module socket for electrical and mechanical connection to an interconnect substrate;

one or more electronic components; and a flexible circuit board comprising a flexible substrate having a component portion supporting the one or more electronic components and a contact portion supporting a plurality of elongated electrical conductors and coupled to the component portion through a curved portion, wherein the component portion of the flexible substrate is disposed within the housing and the contact portion of the flexible substrate is disposed outside of the housing and is exposed for electrical contact with an electrical connector of the electronic device module socket.

7. The electronic device module of claim 6, wherein the one or more electronic components are supported on one surface of the flexible substrate and at least a portion of the electrical conductors are supported on an opposite surface of the flexible substrate.

8. The electronic device module of claim 7, wherein the contact portion of the flexible substrate is substantially orthogonal to the component portion of the flexible substrate.

9. The electronic device module of claim 6, wherein the one or more electronic components and the electrical conductors are supported on the same surface of the flexible substrate.

10. The electronic device module of claim 9, wherein the contact portion of the flexible substrate is substantially parallel to the component portion of the flexible substrate.

11. The electronic device module of claim 9, wherein the flexible substrate is folded at the curved portion.

12. A socket-based system for electrically and mechanically connecting an interconnect substrate and an electronic device module, comprising:

a socketable electronic device module, comprising a housing, one or more electronic components, and a flexible circuit board comprising a flexible substrate having a component portion supporting the one or more electronic components and a contact portion supporting a plurality of elongated electrical conductors; and an electronic device module socket, comprising a support frame constructed and arranged to receive the electronic device module, a retainer constructed and arranged to engage and thereby mechanically hold the electronic device module in place, wherein the retainer has a latch portion configured to yield during insertion of the electronic device module into the socket and to snap back over an edge of the electronic device module when fully inserted into the socket, and an electrical connector constructed and arranged to electrically connect the plurality of electrical conductors at the contact portion of the flexible substrate to a corresponding plurality of electrical conductors of the interconnect substrate.

13. A socket-based system for electrically and mechanically connecting an interconnect substrate and an electronic device module, comprising:

a socketable electronic device module, comprising a housing, one or more electronic components, and a flexible circuit board comprising a flexible substrate having a component portion supporting the one or more electronic components and a contact portion supporting a plurality of elongated electrical conductors, wherein the contact portion of the flexible substrate is coupled to the component portion through a curved substrate portion; and an electronic device module socket, comprising a support frame constructed and arranged to receive the electronic device module, a retainer constructed and arranged to engage and thereby mechanically hold the electronic device module in place, and an electrical connector constructed and arranged to electrically connect the plurality of electrical conductors at the contact portion of the flexible substrate to a corresponding plurality of electrical conductors of the interconnect substrate.

14. A socket-based system for electrically and mechanically connecting an interconnect substrate and an electronic device module, comprising:

a socketable electronic device module, comprising a housing, one or more electronic components, and a flexible circuit board comprising a flexible substrate having a component portion supporting the one or more electronic components and a contact portion supporting a plurality of elongated electrical conductors, wherein the component portion of the flexible substrate is disposed within the housing and the contact portion of the flexible substrate is disposed outside of the housing; and an electronic device module socket, comprising a support frame constructed and arranged to receive the electronic device module, a retainer constructed and arranged to engage and thereby mechanically hold the electronic device module in place, and an electrical connector constructed and arranged to electrically connect the plurality of electrical conductors at the contact portion of the flexible substrate to a corresponding plurality of electrical conductors of the interconnect substrate.

15. The socket-based system of claim 12, wherein the one or more electronic components are supported on one surface of the flexible substrate and at least a portion of the electrical conductors are supported on an opposite surface of the component portion of the flexible substrate.

16. The socket-based system of claim 12, wherein the one or more electronic components and the electrical conductors are supported on the same surface of the flexible substrate.

17. The socket-based system of claim 12, wherein the electrical connector is constructed and arranged to be biased against the plurality of elongated flexible circuit board conductors when the electronic device module is mechanically held in place by the retainer.

18. The socket-based system of claim 17, wherein the electrical connector comprises a plurality of electrically conductive spring fingers.

19. The socket-based system of claim 17, wherein the electrical connector comprises an elastomeric anisotropic electrically conductive film.

* * * * *